US006746628B2

(12) United States Patent
Kamikoriyama et al.

(10) Patent No.: US 6,746,628 B2
(45) Date of Patent: Jun. 8, 2004

(54) AQUEOUS NICKEL SLURRY, METHOD FOR PREPARING THE SAME AND CONDUCTIVE PASTE

(75) Inventors: Yoichi Kamikoriyama, Ageo (JP); Sumikazu Ogata, Ageo (JP)

(73) Assignee: Mitsui Mining and Smelting Co., Ltd., Tokyo (JP)

( * ) Notice: Subject to any disclaimer, the term of this patent is extended or adjusted under 35 U.S.C. 154(b) by 241 days.

(21) Appl. No.: 10/074,010

(22) Filed: Feb. 14, 2002

(65) Prior Publication Data

US 2003/0001142 A1 Jan. 2, 2003

(30) Foreign Application Priority Data

Feb. 15, 2001 (JP) ..... 2001-038113

(51) Int. Cl.[7] ..... H01B 1/02
(52) U.S. Cl. ..... 252/513; 106/1.05
(58) Field of Search ..... 252/513; 106/1.05

(56) References Cited

U.S. PATENT DOCUMENTS 4,613,454 A * 9/1986 Keiser ..... 516/80
4,774,270 A * 9/1988 Sullivan et al. ..... 523/334
5,158,604 A * 10/1992 Morgan et al. ..... 106/1.23

* cited by examiner

*Primary Examiner*—Mark Kopec
(74) *Attorney, Agent, or Firm*—Young & Thompson

(57) ABSTRACT

An aqueous nickel slurry of the present invention comprises water, nickel fine powder provided thereon with an insoluble inorganic oxide adhered to the surface of the individual nickel fine particles constituting the fine powder, polyacrylic acid or an ester or salt thereof and at least one member selected from the group consisting of ammonium hydroxides substituted with organic substituents and hydroxyl group-containing amine compounds. The aqueous nickel slurry comprises nickel fine powder stably dispersed in the slurry in a high concentration without causing any re-agglomeration and can be used as a conductive paste for firing, in particular, a conductive paste for use in making a multilayer ceramic capacitor. The aqueous nickel slurry comprising nickel fine powder stably dispersed in the slurry in a high concentration without causing any re-agglomeration is prepared by the method of the present invention.

19 Claims, No Drawings

AQUEOUS NICKEL SLURRY, METHOD FOR PREPARING THE SAME AND CONDUCTIVE PASTE

BACKGROUND OF THE INVENTION

1. Field of the Invention

The present invention relates to an aqueous nickel slurry, a method for preparing the same and a conductive paste. More specifically, the present invention relates to an aqueous nickel slurry in which nickel fine particles are stably dispersed in a high concentration without again causing any cohesion and which can be used as a conductive paste for firing, in particular, a conductive paste for forming a multilayer ceramic capacitor as well as a method for preparing the aqueous nickel slurry and a conductive paste.

2. Description of the Prior Art

A multilayer ceramic capacitor comprises a plurality of alternately laminated ceramic dielectric layers and internal electrode layers, which are integrated together. Such a multilayer ceramic capacitor can, for instance, be prepared according to the following method. A ceramic dielectric material is first dispersed in a medium to give a slurry. On the other hand, metal fine powder as a material for internal electrodes is converted into a paste to thus give a conductive paste. Then a green sheet is prepared from the ceramic dielectric slurry, the conductive paste is printed on the green sheet, another green sheet is put on top of the printed green sheet and then the foregoing steps are repeated over a desired time to thus give a laminate, which comprises a desired number of the green sheets of the ceramic dielectric and a desired number of the printed conductive paste layers, alternately laminated. Alternatively, the ceramic dielectric slurry and the conductive paste are alternately subjected to screen printing to give a laminate comprising a plurality of printed ceramic dielectric layers and conductive paste layers. Then the resulting laminated layers are attached to one another using pressure with heating and then the resulting laminate is fired in a reducing atmosphere at a high temperature to thus unify the ceramic dielectric layers and the internal electrode layers.

As such materials for internal electrodes, there have been used, for instance, platinum, palladium and silver-palladium, but there have recently been developed and advanced techniques for employing base metals such as nickel in place of precious metals such as platinum, palladium and silver-palladium in order to save the production cost. Moreover, the conductive paste used for the production of internal electrodes for multilayer ceramic capacitors is in general prepared by if necessary adding an inorganic substance such as a vitreous material and other additives to a vehicle comprising, for instance, an organic binder and an organic solvent, in addition to nickel powder for imparting conductivity to the resulting paste and then uniformly mixing these components to give a uniform dispersion.

Incidentally, the size of the foregoing multilayer ceramic capacitor or the like has recently been increasingly reduced and this correspondingly leads to the gradual reduction of the thickness of ceramic dielectric layers and internal electrode layers constituting each capacitor and to the increase in the number of laminated layers. In fact, there have been produced such a laminated part, in particular, a multilayer ceramic capacitor, which has a thickness of the dielectric layer of not more than 2 $\mu$m, a thickness of the internal electrode film of not more than 1.5 $\mu$m and a number of the laminated layers of not less than 400.

Recently, there have been proposed a variety of techniques for further reducing the thickness of the internal electrode layer to thus give a chip laminated to a higher extent. Among these techniques, there has been known a method, which makes use of an aqueous conductive paste instead of the conventional organic solvent-containing conductive paste. The use of an aqueous conductive paste has attracted special interest recently from the viewpoint of the environmental hygiene.

In general, the metal powder produced by a dry or wet reaction is in a cohered state in itself although the degree of cohesion may vary depending on the kinds thereof. Moreover, the smaller the primary particle size of the metal powder, the higher the degree of such cohesion.

The nickel powder may likewise be prepared by either a dry or wet reaction method. In case of the nickel powder, however, it is a matter of course that such cohesion becomes a serious problem. Moreover, even if the cohered nickel powder is de-agglomerated by a disintegration treatment, nickel particles again undergo agglomeration with time in water.

There have been conducted various studies, in which nickel powder is disintegrated in the presence of a variety of dispersants and/or surfactants, to solve the problem of re-agglomeration and to obtain an aqueous nickel slurry having a high concentration, but the nickel concentration of the slurry thus prepared is in general on the order of about 10% by mass and these techniques never permitted the preparation of a nickel slurry having a nickel concentration of higher than 20% by mass. Although an aqueous nickel slurry having a high concentration could temporarily be obtained, nickel particles present therein necessarily undergo re-agglomeration. For this reason, it has been impossible to maintain nickel particles in their stably dispersed condition in the slurry. Therefore, the foregoing techniques never allow the preparation of a stable aqueous nickel slurry having a high nickel concentration.

SUMMARY OF THE INVENTION

Accordingly, it is an object of the present invention to provide an aqueous nickel slurry in which nickel fine particles are stably dispersed in a high concentration without again causing any cohesion (or causing re-agglomeration) and which can be used as a conductive paste for firing, in particular, a conductive paste for use in making a multilayer ceramic capacitor.

It is another object of the present invention to provide a method for preparing the foregoing aqueous nickel slurry.

It is a further object of the present invention to provide a conductive paste prepared from the foregoing aqueous nickel slurry.

The inventors of this invention have conducted various investigations according to a rule of trial and error on the basis of a variety of hypotheses, have fortunately found that nickel fine particles may stably be dispersed in a high concentration in an aqueous slurry without causing any re-agglomeration if a specific substance is adhered to the surface of individual nickel particles and a specific compound is dissolved in an aqueous medium in advance, have further conducted various investigations and have thus completed the present invention.

According to a first aspect of the present invention, there is provided an aqueous nickel slurry, which comprises:

water;

nickel fine powder provided thereon with an insoluble inorganic oxide adhered to the surface of the individual nickel fine particles constituting the fine powder;

polyacrylic acid or an ester or salt thereof; and at least one member selected from the group consisting of ammonium hydroxides substituted with organic substituents, and hydroxyl group-containing amine compounds.

According to a second aspect of the present invention, there is provided a method for preparing an aqueous nickel slurry, which comprises the steps of dispersing, in water, nickel fine powder provided thereon with an insoluble inorganic oxide adhered to the surface of the individual nickel fine particles constituting the fine powder, adding: polyacrylic acid or an ester or salt thereof; and at least one member selected from the group consisting of ammonium hydroxides substituted with organic substituents and hydroxyl group-containing amine compounds to the resulting aqueous dispersion and then stirring the resulting mixture.

According to a third aspect of the present invention, there is provided a conductive paste, in particular, a conductive paste for use in forming a multilayer ceramic capacitor, which comprises the foregoing aqueous nickel slurry and a binder.

DESCRIPTION OF THE PREFERRED EMBODIMENTS

In the aqueous nickel slurry of the present invention, the nickel fine powder can be stably dispersed in an aqueous slurry in a high nickel concentration without causing any re-agglomeration and can be used as a conductive paste, in particular, as a conductive paste for use in the formation of a multilayer ceramic capacitor, if the average primary particle size of the nickel fine particles as a starting material ranges from 0.05 to 1 $\mu$m, more preferably 0.1 to 0.6 $\mu$m and particularly preferably 0.1 to 0.3 $\mu$m.

The inventors of this invention have first repeated various experiments using nickel fine powder, which is not subjected to any surface treatment, various well-known dispersants and surfactants, for the purpose of the preparation of stable aqueous nickel slurries each having a high nickel concentration, which do not cause any re-agglomeration. However, any satisfactory result could not be obtained in all of the cases examined. Under such circumstances, the inventors hit upon such an idea that the surface of nickel fine powder is treated with another substance or such a substance is adhered to the surface of the individual nickel fine particles and have further repeated a variety of investigations. As a result, the inventors have found that satisfactory results can be obtained by adhering a specific substance to the surface of nickel fine particles and dispersing the nickel fine particles carrying the specific substance adhered thereto in water in which another specific substance is dissolved in advance.

In the aqueous nickel slurry according to the present invention, the insoluble inorganic oxide adhered to the surface of individual nickel fine particles may be at least one member selected from the group consisting of oxides and double oxides containing silicon, aluminum, zirconium or titanium, such as silicon oxide, aluminum oxide, zirconium oxide, titanium oxide, barium titanate and calcium zirconate. These insoluble inorganic oxides may be partially or completely adhered to the surface of the individual nickel particles constituting nickel fine powder. For instance, one of the methods for adhering such an oxide to the surface of the particles comprises the step of directly adhering ultrafine particles of an insoluble inorganic oxide per se to nickel fine particles or depositing an insoluble inorganic oxide on nickel fine particles through a chemical reaction of an aqueous solution containing a precursor compound of the insoluble inorganic oxide, as described in, for instance, Japanese Un-Examined Patent Publication No. 2000-282102.

The nickel fine powder provided thereon with the insoluble inorganic oxide adhered to the surface of the individual fine particles can be obtained by, for instance, disintegrating nickel fine powder in water, adding ultrafine particles of an insoluble inorganic oxide, colloidal silica or the like to the disintegrated aqueous nickel dispersion, disintegrating and mixing the resulting mixture, removing the moisture from the mixture to thus adhere the ultrafine particles of the insoluble inorganic oxide onto the surface of the individual nickel fine particles.

When ultrafine particles of an insoluble inorganic oxide are adhered to the surface of individual nickel fine particles, the primary particle size of the ultrafine particles of the inorganic oxide is preferably not more than 0.1 $\mu$m and more preferably 0.01 to 0.05 $\mu$m and the average primary particle size thereof is preferably not more than 0.2 time and more preferably not more than 0.15 time that of the nickel fine particles to be treated with the same.

In the aqueous nickel slurry according to the present invention, the amount of the insoluble inorganic oxide adhered to the surface of the nickel fine particles preferably ranges from 0.05 to 10% by mass, more preferably 0.1 to 5% by mass and particularly preferably 0.5 to 2% by mass on the basis of the total mass of the nickel present in the slurry.

In the aqueous nickel slurry of the present invention, the aqueous medium for the slurry should include: polyacrylic acid or an ester or salt thereof; and at least one member selected from the group consisting of ammonium hydroxides substituted with organic groups (such as alkyl and/or aryl groups) and hydroxyl group-containing amine compounds and the medium preferably comprises both the ammonium hydroxide and the hydroxyl group-containing amine compound, in order to obtain an aqueous slurry, which comprises the nickel fine powder provided thereon with an insoluble inorganic oxide adhered to the surface of the nickel fine particles, in a stably dispersed condition in a high nickel concentration without causing any re-agglomeration. Although the reason why it is effective for the aqueous nickel slurry of the present invention to simultaneously use these polyacrylic acid compound and an organic group-substituted ammonium hydroxide and/or a hydroxyl group-containing amine compound has not yet been clearly elucidated, this has been empirically derived from a large number of experiments.

Examples of polyacrylic acid and esters or salts thereof usable in the aqueous nickel slurry of the present invention are polyacrylic acid, poly(methyl acrylate), sodium polyacrylate and ammonium polyacrylate, with ammonium polyacrylate being particularly preferred.

Examples of organic group-substituted ammonium hydroxides usable in the aqueous nickel slurry of the present invention are alkyl group-substituted ammonium hydroxides such as tetramethyl ammonium hydroxide, tetraethyl ammonium hydroxide and tetrabutyl ammonium hydroxide and alkyl group-substituted and aryl group-substituted ammonium hydroxides such as trimethyl phenyl ammonium hydroxide and benzyl trimethyl ammonium hydroxide, with alkyl group-substituted ammonium hydroxides being preferably used herein.

Examples of hydroxyl group-containing amine compounds usable in the aqueous nickel slurry of the present invention are alkanolamines, in particular, dialkanolamines such as dimethanolamine, diethanolamine and dipropanolamine, with diethanolamine being preferably used herein.

In the aqueous nickel slurry of the present invention, the amount of the polyacrylic acid or an ester or salt thereof preferably ranges from about 0.05 to 5% by mass and more preferably about 0.1 to 2% by mass on the basis of the total mass of the nickel present in the slurry. In addition, if the organic group-substituted ammonium hydroxide is present in the aqueous slurry, the amount thereof preferably ranges from about 1 to 30% by mass and more preferably about 5 to 20% by mass on the basis of the total amount (mass) of the polyacrylic acid or an ester or salt thereof. Moreover, if the hydroxyl group-containing amine compound is present in the aqueous slurry, the amount thereof preferably ranges from about 0.5 to 10% by mass and more preferably about 1 to 7% by mass on the basis of the total mass of the nickel.

In the aqueous nickel slurry of the present invention, nickel fine powder may be stably dispersed in the aqueous medium for the slurry in a considerably high nickel concentration without being accompanied by any re-agglomeration of nickel particles if the foregoing polyacrylic acid or an ester or salt thereof and at least one or preferably both of the organic group-substituted ammonium hydroxide and the hydroxyl group-containing amine compound are simultaneously incorporated into the aqueous medium for the slurry. According to the present invention, the concentration of the nickel fine powder provided thereon with an insoluble inorganic oxide adhered to the surface of the individual nickel fine particles can be increased to a level of not less than 25% by mass, not less than 30% by mass if desired and even to a level of not less than 35% by mass.

Moreover, the aqueous nickel slurry of the present invention has a viscosity value of not more than 20 cP as measured, for example, by RheoStress 1 (RS 1) (available from Thermo Haake) at a shear rate of 100/sec and a sedimentation velocity value of not more than 1 mm/min as measured by TurbiScan MA 2000 (available from Eko Instruments Trading Co., Ltd.).

More specifically, when the aqueous nickel slurry of the present invention comprises water, nickel fine powder provided thereon with ultrafine particles of an insoluble inorganic oxide (silica, for instance) adhered to the surface of individual nickel particles constituting the fine powder, ammonium polyacrylate and tetraalkyl ammonium hydroxide, good results are obtained if the aqueous slurry comprises, in particular, water, nickel fine powder provided thereon with ultrafine particles of an insoluble inorganic oxide adhered to the surface of individual nickel particles constituting the fine powder, ammonium polyacrylate, tetraalkyl ammonium hydroxide and iminodiethanol.

In the method for preparing an aqueous nickel slurry according to the present invention, nickel fine powder provided thereon with an insoluble inorganic oxide adhered to the surface of individual nickel particles constituting the fine powder is first dispersed in water. Then, to the resulting dispersion, there are added polyacrylic acid or an ester or salt thereof and at least one member selected from the group consisting of organic group-substituted ammonium hydroxides and hydroxyl group-containing amine compounds, the mixture is stirred, subjected to a wet disintegration treatment and, if desired, coarse particles are removed from the resulting dispersion.

The foregoing method of the present invention permits the preparation of the aqueous nickel slurry of the present invention, which is quite stable even in a high nickel concentration on the order of 25 to 50% by mass without causing any re-agglomeration. Moreover, the aqueous nickel slurry of the present invention can be used as a conductive paste, in particular, a conductive paste for use in making a multilayer ceramic capacitor if a binder such as cellulose resins including ethyl cellulose and nitrocellulose, acrylic resins and phenolic resins is added to the slurry.

The aqueous nickel slurry of the present invention comprises nickel fine powder stably dispersed in the slurry in a high concentration without causing any re-agglomeration and can be used as a conductive paste for firing, in particular, a conductive paste for use in making a multilayer ceramic capacitor. Moreover, the method of the present invention permits the preparation of an aqueous nickel slurry in which nickel fine particles are stably dispersed in a high concentration and which never undergoes any re-agglomeration.

The present invention will hereunder be described in more detail with reference to the following working Examples and Comparative Examples, but the present invention is not restricted to these specific Examples at all.

EXAMPLE 1

To a 20L volume container equipped with a large-sized stirring blade, there was added 6500 g of pure water, 3500 g of nickel fine powder having a primary particle size of 0.2 $\mu$m (available from Mitsui Mining and Smelting Co., Ltd.) was gradually added to the container with stirring at a stirring speed of 200 rpm, followed by stirring of the mixture for 20 minutes, addition of 175 g of 20% by mass colloidal silica dispersion (average primary particle size of 0.02 $\mu$m, SNOWTEX O available from Nissan Chemical Industries, Ltd.) and additional stirring of the resulting mixture for 20 minutes.

Then this dispersion containing nickel fine particles and colloidal silica particles was continuously disintegrated and mixed using DYNOMILL (available from Willy A. Bachofen AG Maschinenfabrik) containing zirconia beads having a particle size of 0.8 mm.

Subsequently, the resulting slurry was dried at 120° C. for 24 hours to thus give nickel fine powder provided with silica adhered to the surface of the individual nickel fine particles. This dried product carrying silica adhered thereto was disintegrated in a mixer and then classified through a vibrating screen having an opening of 20 $\mu$m to give desired fine powder. The resulting fine powder was hereunder referred to as "nickel fine powder A" for convenience.

On the other hand, to a one liter volume beaker, there were added 380 g of diethanolamine (available from Wako Pure Chemical Industries, Ltd.), 46 g of a 44% ammonium polyacrylate solution (available from Wako Pure Chemical Industries, Ltd.), 14 g of a 15% tetramethyl ammonium hydroxide solution (available from Wako Pure Chemical Industries, Ltd.) and 560 g of pure water and then the mixture was sufficiently stirred using a magnetic stirrer to give a solution. This solution was hereunder referred to as "dispersing agent X" for convenience.

To a 20L volume container equipped with a large-sized stirring blade, there was added 5750 g of pure water, 3500 g of the nickel fine powder A was gradually added to the container with stirring at a stirring speed of 200 rpm, followed by stirring of the mixture for 20 minutes, addition of 750 g of the dispersing agent X and additional stirring of the resulting mixture for 20 minutes to give a uniform slurry.

Then the resulting slurry was continuously disintegrated and mixed using DYNOMILL containing zirconia beads having a particle size of 0.8 mm.

The resulting slurry was introduced into a 50 L volume container equipped with a large-sized stirring blade, followed by addition of 25000 g of pure water and stirring of the mixture at a stirring speed of 200 rpm to thus give a slurry having a nickel concentration of 10% by mass. This slurry was passed through a cartridge type filter: MCP-HX-E10S available from Advantec Toyo Kaisha, Ltd. for the removal of coarse particles.

The resulting slurry was allowed to stand over 24 hours and the supernatant thereof was removed to give an aqueous nickel slurry having a nickel concentration of 35% by mass. The resulting aqueous nickel slurry was found to have a viscosity of 7 cP as measured by RheoStress 1 (RS 1) (available from Thermo Haake) at a shear rate of 100/sec and a sedimentation velocity of 0.2 mm/min as measured by TurbiScan MA 2000 (available from Eko Instruments Trading Co., Ltd.). Moreover, it was found that the aqueous nickel slurry could pass, by 30 ml, through a filter: Millex SV25 (pore size: 5 $\mu$m) available from Millipore Corporation. More specifically, it was confirmed that the slurry was completely free of any coarse particles, never underwent any re-agglomeration and had a high nickel concentration.

EXAMPLE 2

To a 20L volume container equipped with a large-sized stirring blade, there was added 6500 g of pure water, 3500 g of nickel fine powder having a primary particle size of 0.2 $\mu$m (available from Mitsui Mining and Smelting Co., Ltd.) was gradually added to the container with stirring at a stirring speed of 200 rpm, followed by stirring of the mixture for 20 minutes, addition of 175 g of 20% by mass colloidal silica dispersion (average primary particle size of 0.02 $\mu$m, SNOWTEX O available from Nissan Chemical Industries, Ltd.) and additional stirring of the resulting mixture for 20 minutes.

Then this dispersion containing nickel fine particles and colloidal silica particles was continuously disintegrated and mixed using T. K. FILMICS (available from Tokushu Kika Kogyo Co., Ltd.).

Subsequently, the resulting slurry was dried at 120° C. for 24 hours to thus give nickel fine powder provided with silica adhered to the surface of individual nickel fine particles. This dried product carrying silica adhered thereto was disintegrated in a mixer and then classified through a vibrating screen having an opening of 20 $\mu$m to give desired fine powder. The resulting fine powder was hereunder referred to as "nickel fine powder B" for convenience.

On the other hand, to a one liter volume beaker, there were added 380 g of diethanolamine (available from Wako Pure Chemical Industries, Ltd.), 46 g of a 44% ammonium polyacrylate solution (available from Wako Pure Chemical Industries, Ltd.), 14 g of a 15% tetramethyl ammonium hydroxide solution (available from Wako Pure Chemical Industries, Ltd.) and 560 g of pure water and then the mixture was sufficiently stirred using a magnetic stirrer to give a solution. This solution was hereunder referred to as "dispersing agent X" for convenience.

To a 20L volume container equipped with a large-sized stirring blade, there was added 5750 g of pure water, 3500 g of the nickel fine powder B was gradually added to the container with stirring at a stirring speed of 200 rpm, followed by stirring of the mixture for 20 minutes, addition of 750 g of the dispersing agent X and additional stirring of the resulting mixture for 20 minutes to give a uniform slurry.

Then the resulting slurry was continuously disintegrated and mixed using T. K. FILMICS (available from Tokushu Kika Kogyo Co., Ltd.).

The resulting slurry was introduced into a 50 L volume container equipped with a large-sized stirring blade, followed by addition of 25000 g of pure water and stirring of the mixture at a stirring speed of 200 rpm to thus give a slurry having a nickel concentration of 10% by mass. This slurry was filtered through a cartridge type filter: MCP-HX-E10S available from Advantec Toyo Kaisha, Ltd. for the removal of coarse particles.

The resulting slurry was allowed to stand over 24 hours and the supernatant thereof was removed to give an aqueous nickel slurry having a nickel concentration of 35% by mass. The resulting aqueous nickel slurry was found to have a viscosity of 6 cP as measured by RheoStress 1 (RS 1) (available from Thermo Haake) at a shear rate of 100/sec and a sedimentation velocity of 0.3 mm/min as measured by TurbiScan MA 2000 (available from Eko Instruments Trading Co., Ltd.). Moreover, it was found that the aqueous nickel slurry could pass, by 25 ml, through a filter: Millex SV25 (pore size: 5 $\mu$m) available from Millipore Corporation. More specifically, it was confirmed that the slurry was completely free of any coarse particles, never underwent any re-agglomeration and had a high nickel concentration.

EXAMPLE 3

The same procedures used in Example 1 were repeated to give nickel fine powder A and then the same procedures used in Example 2 were repeated except for using the nickel fine powder A to give an aqueous nickel slurry having a nickel concentration of 35% by mass.

The resulting aqueous nickel slurry was found to have a viscosity of 7 cP as measured by RheoStress 1 (RS 1) (available from Thermo Haake) at a shear rate of 100/sec and a sedimentation velocity of 0.1 mm/min as measured by TurbiScan MA 2000 (available from Eko Instruments Trading Co., Ltd.). Moreover, it was found that the aqueous nickel slurry could pass, by 35 ml, through a filter: Millex SV25 (pore size: 5 $\mu$m) available from Millipore Corporation. More specifically, it was confirmed that the slurry was completely free of any coarse particles, never underwent any re-agglomeration and had a high nickel concentration.

EXAMPLE 4

The same procedures used in Example 2 were repeated to give a slurry having a nickel concentration of 10% by mass and then coarse particles present in the slurry were removed according to the method used in Example 2.

The resulting slurry was allowed to stand over 24 hours and the supernatant thereof was removed to give an aqueous nickel slurry having a nickel concentration of 50% by mass. The resulting aqueous nickel slurry was found to have a viscosity of 8 cP as measured by RheoStress 1 (RS 1) (available from Thermo Haake) at a shear rate of 100/sec and a sedimentation velocity of 0.08 mm/min as measured by TurbiScan MA 2000 (available from Eko Instruments Trading Co., Ltd.). Moreover, it was found that the aqueous nickel slurry could pass, by 30 ml, through a filter: Millex SV25 (pore size: 5 $\mu$m) available from Millipore Corporation. More specifically, it was confirmed that the slurry was completely free of any coarse particles, never underwent any re-agglomeration and had a high nickel concentration.

EXAMPLE 5

To a 20L volume container equipped with a large-sized stirring blade, there was added 6500 g of pure water, 3500 g of nickel fine powder having a primary particle size of 0.2

μm (available from Mitsui Mining and Smelting Co., Ltd.) was gradually added to the container with stirring at a stirring speed of 200 rpm, followed by stirring of the mixture for 20 minutes, addition of 90 g of 20% by mass alumina sol (average primary particle size of 0.01 to 0.02 μm, available from Nissan Chemical Industries, Ltd.) and additional stirring of the resulting mixture for 20 minutes.

Then this dispersion containing nickel fine particles and alumina sol was continuously disintegrated and mixed using DISPER MIX MIXER (available from Mitamura Riken Kogyo Co. Ltd.) at a rotating speed of 2500 rpm.

Subsequently, the resulting slurry was dried at 120° C. for 24 hours to thus give nickel fine powder provided with alumina adhered to the surface of individual nickel fine particles. This dried product carrying alumina adhered thereto was disintegrated in a mixer and then classified through a vibrating screen having an opening of 20 μm to give desired fine powder. The resulting fine powder was hereunder referred to as "nickel fine powder C" for convenience.

On the other hand, to a one liter volume beaker, there were added 380 g of diethanolamine (available from Wako Pure Chemical Industries, Ltd.), 46 g of a 44% ammonium polyacrylate solution (available from Wako Pure Chemical Industries, Ltd.) and 574 g of pure water and then the mixture was sufficiently stirred using a magnetic stirrer to give a solution. This solution was hereunder referred to as "dispersing agent Y" for convenience.

To a 20L volume container equipped with a large-sized stirring blade, there was added 5750 g of pure water, 3500 g of the nickel fine powder C was gradually added to the container with stirring at a stirring speed of 200 rpm, followed by stirring of the mixture for 20 minutes, addition of 750 g of the dispersing agent Y and additional stirring of the resulting mixture for 20 minutes to give a uniform slurry.

Then the resulting slurry was continuously disintegrated and mixed using DISPER MIX MIXER (available from Mitamura Riken Kogyo Co. Ltd.) at a rotating speed of 2500 rpm.

The resulting slurry was introduced into a 50 L volume container equipped with a large-sized stirring blade, followed by addition of 25000 g of pure water and stirring of the mixture at a stirring speed of 200 rpm to thus give a slurry having a nickel concentration of 10% by mass. This slurry was filtered through a cartridge type filter: MCP-HX-E10S available from Advantec Toyo Kaisha, Ltd. for the removal of coarse particles.

The resulting slurry was allowed to stand over 24 hours and the supernatant thereof was removed to give an aqueous nickel slurry having a nickel concentration of 35% by mass. The resulting aqueous nickel slurry was found to have a viscosity of 17 cP as measured by RheoStress 1 (RS 1) (available from Thermo Haake) at a shear rate of 100/sec and a sedimentation velocity of 0.6 mm/min as measured by TurbiScan MA 2000 (available from Eko Instruments Trading Co., Ltd.). Moreover, it was found that the aqueous nickel slurry could pass, by 10 ml, through a filter: Millex SV25 (pore size: 5 μm) available from Millipore Corporation. More specifically, it was confirmed that the slurry was completely free of any coarse particles, never underwent any re-agglomeration and had a high nickel concentration.

EXAMPLE 6

To a 20L volume container equipped with a large-sized stirring blade, there was added 6500 g of pure water, 3500 g of nickel fine powder having a primary particle size of 0.2 μm (available from Mitsui Mining and Smelting Co., Ltd.) was gradually added to the container with stirring at a stirring speed of 200 rpm, followed by stirring of the mixture for 20 minutes, addition of 190 g of 20% by mass zirconia sol (NYACOL; average primary particle size of 0.05 μm; available from Nano Technologies, Inc.) and additional stirring of the resulting mixture for 20 minutes.

Then this dispersion containing nickel fine particles and zirconia sol was continuously disintegrated and mixed using SC Mill (available from Mitsui Mining Co., Ltd.) containing zirconia beads having a particle size of 0.3 mm.

Subsequently, the resulting slurry was dried at 120° C. for 24 hours to thus give nickel fine powder provided with zirconia adhered to the surface of individual nickel fine particles. This dried product carrying zirconia adhered thereto was disintegrated in a mixer and then classified through a vibrating screen having an opening of 20 μm to give desired fine powder. The resulting fine powder was hereunder referred to as "nickel fine powder D" for convenience.

On the other hand, to a one liter volume beaker, there were added 46 g of a 44% ammonium polyacrylate solution (available from Wako Pure Chemical Industries, Ltd.), 14 g of a 15% tetramethyl ammonium hydroxide solution (available from Wako Pure Chemical Industries, Ltd.) and 940 g of pure water and then the mixture was sufficiently stirred using a magnetic stirrer to give a solution. This solution was hereunder referred to as "dispersing agent Z" for convenience.

To a 20L volume container equipped with a large-sized stirring blade, there was added 5750 g of pure water, 3500 g of the nickel fine powder D was gradually added to the container with stirring at a stirring speed of 200 rpm, followed by stirring of the mixture for 20 minutes, addition of 750 g of the dispersing agent Z and additional stirring of the resulting mixture for 20 minutes to give a uniform slurry.

Then the resulting slurry was continuously disintegrated and mixed using SC Mill containing zirconia beads having a particle size of 0.3 mm.

The resulting slurry was introduced into a 50 L volume container equipped with a large-sized stirring blade, followed by addition of 25000 g of pure water and stirring of the mixture at a stirring speed of 200 rpm to thus give a slurry having a nickel concentration of 10% by mass. This slurry was filtered through a cartridge type filter: MCP-HX-E10S available from Advantec Toyo Kaisha, Ltd. for the removal of coarse particles.

The resulting slurry was allowed to stand over 24 hours and the supernatant thereof was removed to give an aqueous nickel slurry having a nickel concentration of 35% by mass. The resulting aqueous nickel slurry was found to have a viscosity of 16 cP as measured by RheoStress 1 (RS 1) (available from Thermo Haake) at a shear rate of 100/sec and a sedimentation velocity of 0.8 mm/min as measured by TurbiScan MA 2000 (available from Eko Instruments Trading Co., Ltd.). Moreover, it was found that the aqueous nickel slurry could pass, by 10 ml, through a filter: Millex SV25 (pore size: 5 μm) available from Millipore Corporation. More specifically, it was confirmed that the slurry was completely free of any coarse particles, never underwent any re-agglomeration and had a high nickel concentration.

EXAMPLE 7

To a 20L volume container equipped with a large-sized stirring blade, there was added 6500 g of pure water, 3500 g of nickel fine powder having a primary particle size of 0.4

μm (available from Mitsui Mining and Smelting Co., Ltd.) was gradually added to the container with stirring at a stirring speed of 200 rpm, followed by stirring of the mixture for 20 minutes, addition of 190 g of 20% by mass zirconia sol (NYACOL; average primary particle size of 0.05 μm; available from Nano Technologies, Inc.) and additional stirring of the resulting mixture for 20 minutes.

Then this dispersion containing nickel fine particles and zirconia sol was continuously disintegrated and mixed using ULTIMYZER (available from Sugino Machine Ltd.).

Subsequently, the resulting slurry was dried at 120° C. for 24 hours to thus give nickel fine powder provided with zirconia adhered to the surface of individual nickel fine particles. This dried product carrying zirconia adhered thereto was disintegrated in a mixer and then classified through a vibrating screen having an opening of 20 μm to give desired fine powder. The resulting fine powder was hereunder referred to as "nickel fine powder E" for convenience.

On the other hand, to a one liter volume beaker, there were added 380 g of diethanolamine (available from Wako Pure Chemical Industries, Ltd.), 46 g of a 44% ammonium polyacrylate solution (available from Wako Pure Chemical Industries, Ltd.), 14 g of a 15% tetramethyl ammonium hydroxide solution (available from Wako Pure Chemical Industries, Ltd.) and 560 g of pure water and then the mixture was sufficiently stirred using a magnetic stirrer to give a solution. This solution was hereunder referred to as "dispersing agent X" for convenience.

To a 20L volume container equipped with a large-sized stirring blade, there was added 5750 g of pure water, 3500 g of the nickel fine powder E was gradually added to the container with stirring at a stirring speed of 200 rpm, followed by stirring of the mixture for 20 minutes, addition of 750 g of the dispersing agent X and additional stirring of the resulting mixture for 20 minutes to give a uniform slurry.

Then the resulting slurry was continuously disintegrated and mixed using DISPER MIX MIXER (available from Mitamura Riken Kogyo Co. Ltd.).

The resulting slurry was introduced into a 50 L volume container equipped with a large-sized stirring blade, followed by addition of 25000 g of pure water and stirring of the mixture at a stirring speed of 200 rpm to thus give a slurry having a nickel concentration of 10% by mass. This slurry was filtered through a cartridge type filter: MCP-HX-E10S available from Advantec Toyo Kaisha, Ltd. for the removal of coarse particles.

The resulting slurry was allowed to stand over 24 hours and the supernatant thereof was removed to give an aqueous nickel slurry having a nickel concentration of 35% by mass. The resulting aqueous nickel slurry was found to have a viscosity of 12 cP as measured by RheoStress 1 (RS 1) (available from Thermo Haake) at a shear rate of 100/sec and a sedimentation velocity of 0.2 mm/min as measured by TurbiScan MA 2000 (available from Eko Instruments Trading Co., Ltd.). Moreover, it was found that the aqueous nickel slurry could pass, by 20 ml, through a filter: Millex SV25 (pore size: 5 μm) available from Millipore Corporation. More specifically, it was confirmed that the slurry was completely free of any coarse particles, never underwent any re-agglomeration and had a high nickel concentration.

COMPARATIVE EXAMPLE 1

The same procedures used in Example 1 were repeated except that any dispersing agent X was not used to give a slurry prior to the removal of coarse particles.

The resulting slurry could pass through a cartridge type filter: TCPD-3-S1FE but could not through a cartridge type filter: TCPD-02A-S1FE at all, both filters available from Advantec Toyo Kaisha, Ltd. The slurry which passed through the filter: TCPD-3-S1FE was found to have a viscosity of 5 cP as measured by RheoStress 1 (RS 1) (available from Thermo Haake) at a shear rate of 100/sec and a sedimentation velocity of 1.8 mm/min as measured by TurbiScan MA 2000 (available from Eko Instruments Trading Co., Ltd.). It was attempted to evaluate this slurry using a filter: Millex SV25 (pore size: 5 μm) available from Millipore Corporation. However, it was found that the slurry could not pass through the filter at all although the concentration of the slurry was low.

COMPARATIVE EXAMPLE 2

To a 20L volume container equipped with a large-sized stirring blade, there was added 6500 g of pure water, 3500 g of nickel fine powder having a primary particle size of 0.2 μm (available from Mitsui Mining and Smelting Co., Ltd.) was gradually added to the container with stirring at a stirring speed of 200 rpm, followed by stirring of the mixture for 20 minutes, addition of 175 g of 20% by mass colloidal silica dispersion (average primary particle size of 0.02 μm, SNOWTEX O available from Nissan Chemical Industries, Ltd.) and additional stirring of the resulting mixture for 20 minutes.

Then this dispersion containing nickel fine particles and colloidal silica particles was continuously disintegrated and mixed using T. K. FILMICS (available from Tokushu Kika Kogyo Co., Ltd.) to prepare a nickel slurry. The resulting slurry was hereunder referred to as "nickel slurry F" for convenience.

On the other hand, to a one liter volume beaker, there were added 380 g of diethanolamine (available from Wako Pure Chemical Industries, Ltd.), 46 g of a 44% ammonium polyacrylate solution (available from Wako Pure Chemical Industries, Ltd.), 14 g of a 15% tetramethyl ammonium hydroxide solution (available from Wako Pure Chemical Industries, Ltd.) and 560 g of pure water and then the mixture was sufficiently stirred using a magnetic stirrer to give a solution. This solution was hereunder referred to as "dispersing agent X" for convenience.

To a 20L volume container equipped with a large-sized stirring blade, there was added 10000 g of the nickel slurry F, 750 g of the dispersing agent X was added to the container with stirring at a stirring speed of 200 rpm to give a uniform slurry.

Then the resulting slurry was continuously disintegrated and mixed using T. K. FILMICS (available from Tokushu Kika Kogyo Co., Ltd.).

The resulting slurry was introduced into a 50 L volume container equipped with a large-sized stirring blade, followed by addition of 24250 g of pure water and stirring of the mixture at a stirring speed of 200 rpm to thus give a slurry having a nickel concentration of 10% by mass. The resulting slurry could pass through a cartridge type filter: TCPD-02A-S1FE but could not through a filter: MCP-HX-E10S at all, both filters available from Advantec Toyo Kaisha, Ltd. The slurry which could pass through the filter: TCPD-02A-S1FE was found to have a viscosity of 10 cP as measured by RheoStress 1 (RS 1) (available from Thermo Haake) at a shear rate of 100/sec and a sedimentation velocity of 1.2 mm/min as measured by TurbiScan MA 2000 (available from Eko Instruments Trading Co., Ltd.). It was attempted to evaluate this slurry using a filter: Millex SV25

(pore size: 5 μm) available from Millipore Corporation. However, it was found that the slurry could not pass through the filter at all although the concentration of the slurry was low.

What is claimed is:

1. An aqueous nickel slurry comprising:

water;

nickel fine powder provided thereon with an insoluble inorganic oxide adhered to the surface of the individual nickel fine particles constituting the fine powder;

polyacrylic acid or an ester or salt thereof; and at least one member selected from the group consisting of ammonium hydroxides substituted with organic substituents and hydroxyl group-containing amine compounds.

2. The aqueous nickel slurry as set forth in claim 1, comprising:

water;

nickel fine powder provided thereon with an insoluble inorganic oxide adhered to the surface of the individual nickel fine particles constituting the fine powder;

polyacrylic acid or an ester or salt thereof; and an ammonium hydroxide substituted with organic substituents.

3. The aqueous nickel slurry as set forth in claim 1, comprising:

water;

nickel fine powder provided thereon with an insoluble inorganic oxide adhered to the surface of the individual nickel fine particles constituting the fine powder;

polyacrylic acid or an ester or salt thereof; and a hydroxyl group-containing amine compound.

4. The aqueous nickel slurry as set forth in claim 1, comprising:

water;

nickel fine powder provided thereon with an insoluble inorganic oxide adhered to the surface of the individual nickel fine particles constituting the fine powder;

polyacrylic acid or an ester or salt thereof;

an ammonium hydroxide substituted with organic substituents; and a hydroxyl group-containing amine compound.

5. The aqueous nickel slurry as set forth in claim 1, wherein the concentration of the nickel fine powder provided thereon with the insoluble inorganic oxide adhered to the surface of the individual nickel fine particles in the aqueous nickel slurry is not less than 25% by mass.

6. The aqueous nickel slurry as set forth in claim 5, wherein the amount of the insoluble inorganic oxide adhered to the surface of the individual nickel fine particles ranges from 0.05 to 10% by mass on the basis of the total mass of the nickel, the amount of the polyacrylic acid or the ester or salt thereof ranges from 0.05 to 5% by mass on the basis of the total mass of the nickel, the amount of the ammonium hydroxide substituted with organic substituents, if present, ranges from 1 to 30% by mass on the basis of the total mass of the polyacrylic acid or the ester or salt thereof, and the amount of the hydroxyl group-containing amine compound, if present, ranges from 0.5 to 10% by mass on the basis of the total mass of the nickel.

7. The aqueous nickel slurry as set forth in claim 6, wherein the insoluble inorganic oxide is at least one member selected from the group consisting of oxides and double oxides containing silicon, aluminum, zirconium or titanium.

8. The aqueous nickel slurry as set forth in claim 7, wherein the average primary particle size of the nickel fine particles ranges from 0.05 to 1 μm and the insoluble inorganic oxide is in the form of fine particles whose primary particle size is not more than 0.1 μm and whose average primary particle size is not more than 0.2 time that of the nickel fine particles.

9. The aqueous nickel slurry as set forth in claim 8, wherein the polyacrylic acid or an ester or salt thereof is ammonium polyacrylate, the ammonium hydroxide substituted with organic substituents is tetraalkyl ammonium hydroxide and the hydroxyl group-containing amine compound is diethanolamine.

10. A conductive paste comprising the aqueous nickel slurry as set forth in claim 8 and a binder.

11. The aqueous nickel slurry as set forth in claim 5, wherein the insoluble inorganic oxide is at least one member selected from the group consisting of oxides and double oxides containing silicon, aluminum, zirconium or titanium.

12. The aqueous nickel slurry as set forth in claim 5, wherein the average primary particle size of the nickel fine particles ranges from 0.05 to 1 μm and the insoluble inorganic oxide is in the form of fine particles whose primary particle size is not more than 0.1 μm and whose average primary particle size is not more than 0.2 time that of the nickel fine particles.

13. The aqueous nickel slurry as set forth in claim 5, wherein the polyacrylic acid or an ester or salt thereof is ammonium polyacrylate, the ammonium hydroxide substituted with organic substituents is tetraalkyl ammonium hydroxide and the hydroxyl group-containing amine compound is diethanolamine.

14. The aqueous nickel slurry as set forth in claim 1, wherein the amount of the insoluble inorganic oxide adhered to the surface of the individual nickel fine particles ranges from 0.05 to 10% by mass on the basis of the total mass of the nickel, the amount of the polyacrylic acid or the ester or salt thereof ranges from 0.05 to 5% by mass on the basis of the total mass of the nickel, the amount of the ammonium hydroxide substituted with organic substituents, if present, ranges from 1 to 30% by mass on the basis of the total mass of the polyacrylic acid or the ester or salt thereof, and the amount of the hydroxyl group-containing amine compound, if present, ranges from 0.5 to 10% by mass on the basis of the total mass of the nickel.

15. The aqueous nickel slurry as set forth in claim 1, wherein the insoluble inorganic oxide is at least one member selected from the group consisting of oxides and double oxides containing silicon, aluminum, zirconium or titanium.

16. The aqueous nickel slurry as set forth in claim 1, wherein the average primary particle size of the nickel fine particles ranges from 0.05 to 1 μm and the insoluble inorganic oxide is in the form of fine particles whose primary particle size is not more than 0.1 μm and whose average primary particle size is not more than 0.2 time that of the nickel fine particles.

17. The aqueous nickel slurry as set forth in claim 1, wherein the polyacrylic acid or an ester or salt thereof is ammonium polyacrylate, the ammonium hydroxide substituted with organic substituents is tetraalkyl ammonium hydroxide and the hydroxyl group-containing amine compound is diethanolamine.

18. A conductive paste comprising the aqueous nickel slurry as set forth in claim 1 and a binder.

19. A conductive paste for use in forming a multilayer ceramic capacitor comprising an aqueous nickel slurry as set forth in claim 1 and a binder.

* * * * *